US008877136B1

(12) United States Patent
Razumau

(10) Patent No.: US 8,877,136 B1
(45) Date of Patent: Nov. 4, 2014

(54) METHOD OF PRODUCING SYNTHESIS GAS FROM COAL

(71) Applicant: Andrei Razumau, Foster, RI (US)

(72) Inventor: Andrei Razumau, Foster, RI (US)

( * ) Notice: Subject to any disclaimer, the term of this patent is extended or adjusted under 35 U.S.C. 154(b) by 0 days.

(21) Appl. No.: 14/019,169

(22) Filed: Sep. 5, 2013

Related U.S. Application Data

(60) Provisional application No. 61/696,916, filed on Sep. 5, 2012.

(51) Int. Cl.
*B01J 19/08* (2006.01)

(52) U.S. Cl.
USPC ..... 422/186.22

(58) Field of Classification Search
USPC ..... 422/186.22
See application file for complete search history.

(56) References Cited

U.S. PATENT DOCUMENTS

| | | | |
|---|---|---|---|
| 45,915 | A | 1/1865 | Elmer |
| 460,122 | A | 9/1891 | Edison |
| 555,511 | A | 3/1896 | Jacques |
| 961,912 | A | 6/1910 | Tone |
| 1,282,445 | A | 10/1918 | McKee |
| 1,757,454 | A | 5/1930 | Eisenhut |
| 1,857,799 | A | 5/1932 | Winkler |
| 2,068,448 | A | 1/1937 | Cox |
| 2,353,770 | A | 7/1944 | Suits |
| 2,447,426 | A | 8/1948 | Odberg |
| 2,968,683 | A | 1/1961 | Kossmann |
| 3,384,467 | A | 5/1968 | Ammann et al. |
| 3,988,237 | A | 10/1976 | Davis et al. |
| 4,082,519 | A | 4/1978 | Steiner |
| 4,300,916 | A | 11/1981 | Frewer et al. |
| 4,921,765 | A | 5/1990 | Gmeindl et al. |
| 5,298,340 | A | 3/1994 | Cocks et al. |
| 5,376,469 | A | 12/1994 | Gur et al. |
| 5,554,453 | A | 9/1996 | Steinfeld et al. |
| 6,692,861 | B2 | 2/2004 | Tao |
| 6,997,965 | B2 | 2/2006 | Katayama |
| 7,799,472 | B2 | 9/2010 | Gur |
| 2011/0116979 | A1 | 5/2011 | Yamamoto et al. |

*Primary Examiner* — Kishor Mayekar
(74) *Attorney, Agent, or Firm* — John P. McGonagle

(57) ABSTRACT

A method and apparatus for generating synthesis gas from coal is provided. A conditioned combustible coal element is packed in a metal case. Oxygen mixed with steam and salt water is applied to the coal element. An electrical direct current direct current is applied to the coal element and oxygen/steam/salt water mixture. An arc is generated at the coal element and synthesis gas is generated.

6 Claims, 2 Drawing Sheets

METHOD OF PRODUCING SYNTHESIS GAS FROM COAL

CROSS-REFERENCE TO RELATED APPLICATIONS

Applicant claims the priority benefits of U.S. Provisional Patent Application No. 61/696,916, filed Sep. 5, 2012.

BACKGROUND OF THE INVENTION

This invention relates to a method for the production of synthesis gas, and in particular to a method of producing synthesis gas from coal.

Synthesis gas is a mixture of carbon monoxide and hydrogen. Depending on the production method, the ratio $CO:H_2$ varies from 1:1 to 1:3. Depending on the type of coal used and the conversion type (by water steam or nonstoichiometric quantity of 02), the ratio of components in the gas mixture varies broadly:

$$Q\ (\text{heat}) + CH_4 + 2O_2 = CO_2 + H_2O$$

$$CH_4 + H_2O{:}CO + 3H_2$$

$$CH_4 + \tfrac{1}{2}O_2{:}CO + 2H_2$$

$$\text{—}CH_2\text{—} + H_2O{:}CO + 2H_2$$

$$\text{—}CH_2\text{—} + \tfrac{1}{2}O_2{:}CO + H_2$$

These ratios are also determined by the coal gasification method and conditions. The commonly used Lurgi method produces the following raw gas ratios: 15-18% CO, 38-40% $H_2$, 9-11% $CH_4$, 30-32% $CO_2$. With temperature increase the CO share increases; with pressure increase, $H_2$ and $CH_4$ increase. Impurities may include inert gases ($N_2$, etc.) and $H_2S$, if the raw material contained sulfur. Synthesis gas is cleaned from $H_2S$ and $CO_2$ by selective solvents; CO and $H_2$ ratio is regulated, when required, converting carbon oxide by water steam.

In the present invention the coal used must be conditioned. Several coal conditioning methods are used. Coal in anthracite form is cut to produce cylindrical rods, ⅝" in dia. and 7" long. Each cylindrical rod is sintered in an oven. The coal is sintered at a typical temperature range from 670 to 1050° C., with no air, for 10-14 hours. The temperature may be even higher than this range. The coal sintering temperature (charred coal or partially carbonized coal) is chosen for specific conditions of the synthesis gas.

Another conditioning method uses different types of coal crushed to duct and mixed in different ratios with the fillers, such as: iron, calcium or electric-furnace scrap or open-hearth slag, depending on the desired final gas composition. Temperature impacts remove volatile fractions of resins that can be fractionally distilled to produce targeted fractions.

The combustible coal element is believed to be conditioned as soon as conducts the electric current uniformly in the entire coal fraction.

A catalyst for the coal combustion reaction may be provided. Catalytic gasification processes, based on the direct coal conversion to gaseous compounds, are well known in the prior art. For efficient catalyst impact, the catalyst should have a good contact with hard raw material. To this end, catalysts used are deposited on the coal surface so they can be melted or sublimed in the process, thus getting into pores of the coal. The most common catalysts for coal gasification are compounds of alkali, alkaline-earth and some transition metals (Ni, Fe, Co), able to catalyze CO and hydrocarbon conversion oxidation reaction, methanation. Such catalytically active materials can be used in the process of gasification until they fully wear off at combustion temperatures 850-1400° C. under atmospheric pressure.

In a steam-and-air mixture, the coal conversion to gaseous products may exceed 90%. The gasification intensity exceeds the known gasification technology indicators, under similar temperature and pressure.

In order to ensure a good contact with coal, the following is required. Thermally-processed coal (charred coal or partially carbonized coal) should be impregnated with acetic acid containing dissolved substances based on iron, magnesium and manganese oxides, or molybdenum, chromium or nickel. In particular, metallic iron, ammonium molybdate (NH 4)6 Mo 7 and chromium oxide CrO, potassium permanganate KMnO4 are dissolved in specific ratios, depending on the required final gas composition. The coal element saturated with this solution is dried at 90° C. The combustible coal element is tightly packed by galvanic or other techniques in a cylindrical case, made from alloys: natural pyrite, Fe2O3 or synthetic FeS2, or compounds of Fe, cobalt Co, nickel Ni, or molybdenum Mo, the compounds deposited on $Al_2O_3$. In turn, they are electrical conductors and reaction catalysts. Reaction catalysts can also include acid clays, such as kaolin $Al_2O_3*2SiO_2*2H_2O$ or similar clays.

SUMMARY OF THE INVENTION

The conditioned combustible coal element, packed in a metal case, is connected to a positive clamp of a storage battery or a DC transformer, using an automatic electromagnetic oxygen valve.

When the current is on, the valve is opened and passes the oxygen mixed with steam and acid-water solution to an adaptor. When the arc is interrupted and the current is stopped, the valve automatically stops the supply of oxygen, steam and water. The arc is supplied by DC of normal polarity; the current is normally 1-40 A*h, 12-36 V.

In the gasification device, the combustible coal element is positioned at angle 45°, with the open element side facing upwards.

A coating impregnated with a water-tight compound, for instance, nickel or chromium that are reaction catalysts, is deposited over the tubular rod connected to the negative charge, from carborundum (silicon carbide SiC), the outer dia. 4.5 mm and inner dia. 2-3 mm, coated with steel. The inner channel is not lined, since carborundum has low sensitivity to oxygen. Carborundum is a semiconductor and at low temperatures does not conduct current. When heated, its conductivity rapidly grows up and starting with red heat it is conductive. The current from the adaptor goes over the steel coating and is fed to the carborundum at the heated end of the electrode. The combustible coal element is connected to the positive battery clamp.

The tube is used to supply air oxygen is supplied under pressure, the heated steam already spent in the reaction, which also absorbs sea water or the acid solution, which may contained dissolved metals: magnesium, iron or other chemicals required for the reaction, since they can add oxygen and catalyst to the reaction.

These together with other objects of the invention, along with various features of novelty which characterize the invention, are pointed out with particularity in this disclosure. For a better understanding of the invention, its operating advantages and specific objects attained by its uses, reference should be had to the accompanying drawings and descriptive matter in which there is illustrated a preferred embodiment of the invention.

DETAILED DESCRIPTION OF THE INVENTION

Figure 1:
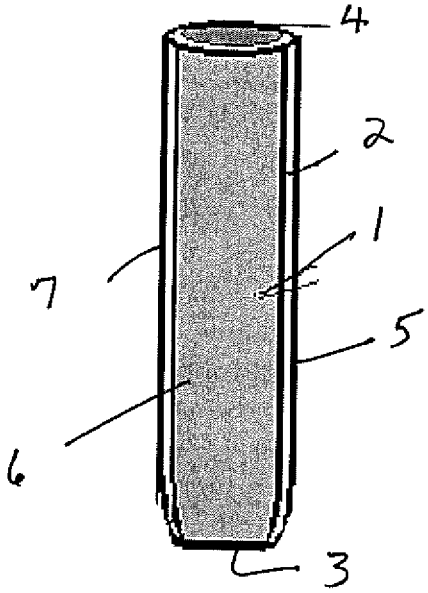
FIG. 1 is a schematic diagram of an encased fuel element.

Referring to the drawings in detail, wherein like elements are indicated by like numerals, there is shown an embodiment of the invention incorporating the invention method.

As may be seen from FIG. 1, the combustible coal element 1 tightly packed in a cylindrical socket 2. The combustible coal element is comprised of a conditioned rod of sintered anthracite coal. The socket 2 has a closed end 3, an open end 4 and a cylindrical sidewall 5 extending from the socket closed end to the socket open end. The socket ends and sidewall define a socket hollow interior 6. The socket 5 has an exterior surface 7. The socket 2 is made from alloys, such as natural pyrite, $Fe_2O_3$ or synthetic $FeS_2$, or compounds of Fe, Cobalt Co, Nickel Ni, or Molybdenum Mo, the compounds deposited on $Al_2O_3$. The alloys are also electrical conductors and reaction catalysts.

Figure 2:
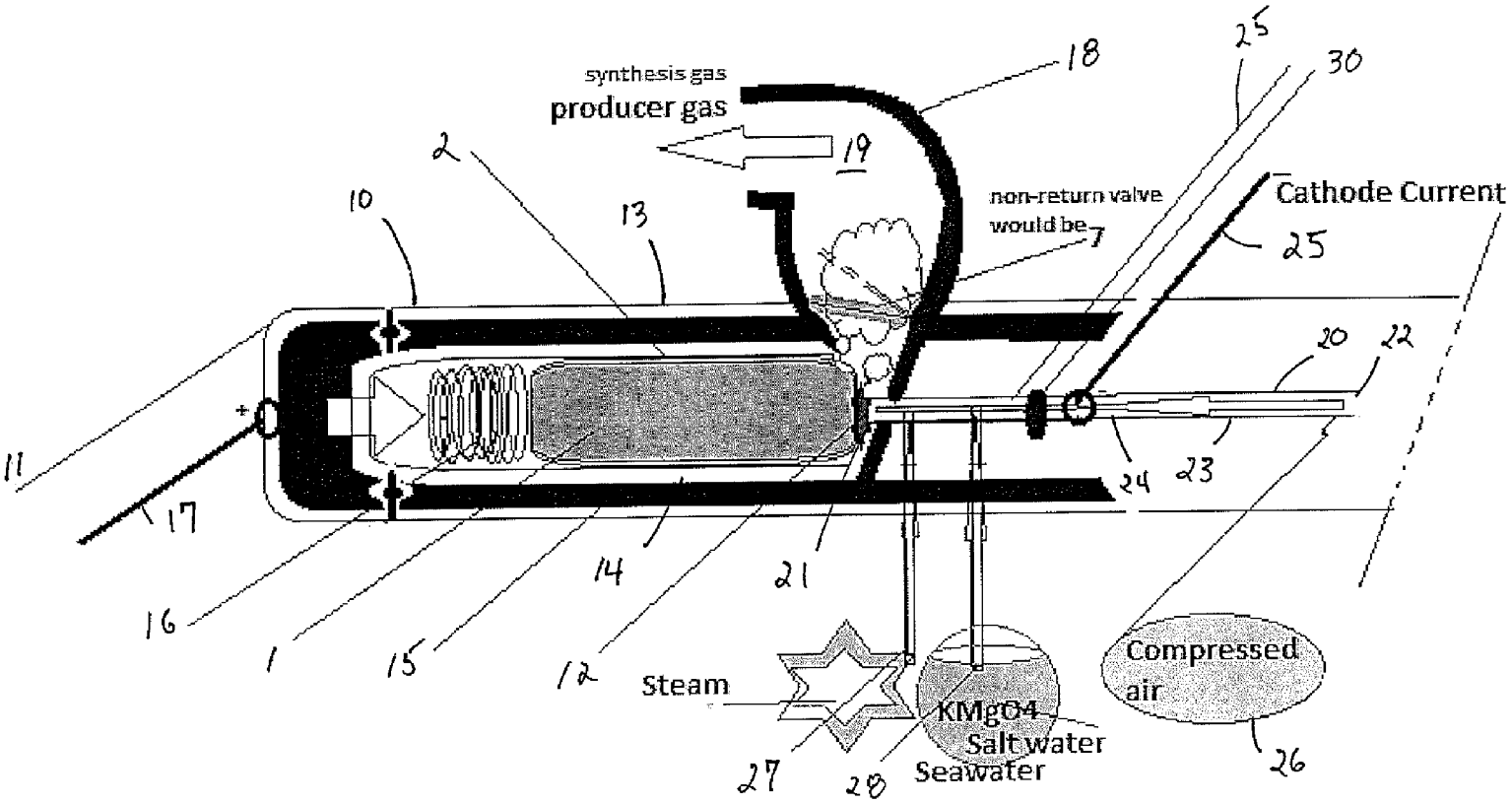
FIG. 2 is a schematic diagram of an apparatus carrying out the method of the invention.

Referring to FIG. 2, there is shown an invention apparatus having a hollow, cylindrical metal case 10, said case 10 having an anode end 11, an opposite cathode end 12, and a cylindrical sidewall 13 extending from said anode end to said cathode end. The case ends and sidewall define a case hollow interior 14. The interior surface 15 of the case is coated with graphite. The case interior 14 contains a coil spring 16 against the case anode end 11. The socket 2 with combustible coal element 1 is placed within the case interior 14 so that the socket closed end 3 is pressed against the case coil spring 16. An anode lead 17 is electrically connected to the case anode end 11. The case coil spring 16 forces the coal element 1 against the case cathode end 12 and first tube end as described below.

A hollow steel tube 20 having two open ends, 21, 22, is provided. A tube first open end 21 is connected to the case cathode end 12 and engages the combustible coal element 1 within the socket 2. A carborundum coating impregnated with a water impervious compound, e.g., nickel or chromium which are also reaction catalysts, is deposited over the tube 20 exterior surface 23. The tube interior 24 is not coated since carborundum has low sensitivity to oxygen. A cathode lead 25 is physically and electrically attached to the tube exterior 23. Carborundum is a semiconductor and, at low temperatures, does not conduct current. When heated, Carborundum's conductivity rapidly grows and, starting with red heat, is conductive. Current supplied to the anode lead 17 and cathode lead 25 from a power source flows over the tube exterior 23 and is fed to carborundum at the tube first end 21 and the case cathode end 12. The electrical flow through the coal element 1 heats the coal element and the tube carborundum. At the point of contact of the tube first end 21 and coal element 1, a powerful charge develops, i.e., arc category, and the coal element is heated red and whose temperature may reach up to 2000° C.

The tube second end 22 is connected to a compressed air supply 26. A steam supply 27 and salt water supply 28 are ducted into the tube interior 24. The compressed air supply draws steam and salt water into the tube 20 where the steam, salt water and air are mixed and forced onto the heated coal element 1. The water, air and steam mixture, contacting the red coal, generates synthesis gas 19. The synthesis gas 19 is captured in an exhaust pipe 18 adjacent the case cathode end 12 and directed to a desired destination. The reaction is endothermic so the fuel must be continuously re-heated to keep the reaction going. The energy needed to generate and maintain an electrical arc at the junction of coal element 1 and first tube end 21 may be produced from a step-up transformer or a storage battery fed from a DC generator.

The above process is further controlled by a solenoid valve 30 in the tube 20. When current is flowing, the valve 30 is opened and allows the air, water and steam mixture to pass to the tube first end 21 and the coal element 1. When the current flow is halted, the valve 30 automatically stops and the mixture flow is halted.

Varying the current and the flow of steam with the air oxygen and sea water or acid mixtures, which can contain various dissolved chemicals, accelerates the process and increases the coal combustion temperature, and, hence, process more steam to combustible gas.

The composition of the gas produced from thermally processed anthracite (combustible coal element):

1. Nitrogen, up to (0.7-1.7%)
2. Hydrogen, up to (15-56.3%)
3. Methane, up to (0.5-1.5%)
4. Carbon oxide, up to (15-28.8%)
5. Carbon dioxide, up to 11.7%

If the sintered coal badly conducts electrical current, it can be heated additionally using a step-up transformer, 40 A*h, 12-36 V, by supplying for a brief time, 10-20 sec, 40 A*h current.

The anode lead 17 is connected to the steel flask case and the cathode lead 25 to the steel-carborundum electrode tubing 20. When the heated combustible coal element 1 contacts air vapor, the upper part of the coal is heated to 1000° C. or more and automatically heats the lower coal layer, 4-5 mm, after which the conditioned coal can be heated rapidly and uniformly.

In summary, the invention is comprised of:

The gasification device is made in a steel case.

The combustible coal element is in its socket and is inserted into the cylindrical case whose walls are treated with graphite powder, which combine the following features: a good electrical current conductor; mechanically resistance to wear; and ability to withstand high temperatures.

The case anode end 11 may be closed by a threaded cap made from copper thereby forming an anode cage.

The combustible coal element can be moved, by vacuum or under pressure, towards the case cathode and 12 and the steel-carborundum electrode (hollow tube first end 21), and pushed tight to the electrode.

The mixed steam and electrical current are supplied towards the combustible coal element over the steel-carborundum electrode.

In the place of contact between the combustible coal element and the electrode, an electric arc is generated between the electrode and the coal element.

The combustible coal element is heated red in the upper part. When steam contacts the red-heated coal, it converts to synthesis gas, and its compression above the atmospheric pressure makes it explosive. Therefore, the place where the synthesis gas is generated should be locked by a return valve; when the gas pressure builds, the valve automatically closes and the gas can be diverted to any gas-using device.

The coal and steam reaction is possible only when electrical current is supplied; therefore the reaction is fully controllable and the process can be stopped instantly by shutting of the electric power.

The produced gas can be used in different internal combustion engines or can be divided into its chemical components, such as hydrogen, nitrogen, methane, carbon oxide and other associated elements. When used in internal combustion engines, the output from the exhaust pipe, i.e., synthesis gas 19, is compressed and injected into the engine's carburetor.

One gallon of a steam mixture gives more than three liters of synthesis gas.

It is understood that the above-described embodiment is merely illustrative of the application. Other embodiments may be readily devised by those skilled in the art which will embody the principles of the invention and fall within the spirit and scope thereof.

I claim:

1. An apparatus for producing synthesis gas, comprising:

a combustible coal element comprised of a conditioned rod of sintered coal tightly packed in a cylindrical socket having a closed end, an open end, a cylindrical sidewall extending from the socket closed end to the socket open end, and an exterior surface, said socket ends and sidewall defining a socket hollow interior;

a hollow, cylindrical metal case having an anode end, an opposite cathode end, a cylindrical sidewall extending from said anode end to said cathode end, and an interior surface, said case cathode end, anode end and sidewall defining a hollow case interior, said case interior surface being coated with graphite, said case interior containing a coil spring against the case anode end, said case interior holding said socket with said combustible coal element with the socket closed end pressed against the case coil spring, said case having an anode lead electrically connected to the case anode end;

a hollow steel tube having two open ends and an exterior surface, wherein said exterior surface is coated with a carborundum coating impregnated with a water impervious compound, wherein a tube first open end is connected to the case cathode end engaging the combustible coal element within the socket, wherein a cathode lead is physically and electrically attached to the tube exterior surface;

a direct current power supply electrically connected to said anode and cathode leads;

wherein a tube second open end is connected to a compressed air supply;

wherein a steam supply and a salt water supply are ducted into the tube interior;

wherein the compressed air supply draws steam and salt water into the tube interior where the steam, salt water and air are mixed and forced onto a heated combustible coal element generating synthesis gas; and an exhaust pipe positioned adjacent the case cathode end, said exhaust pipe adapted to capture the generated synthesis gas.

2. An apparatus as described in claim 1, further comprising:

a solenoid valve in the tube which is configured to open when electrical current is flowing from the said power supply allowing an air, water and steam mixture to pass to the tube first end and combustible coal element, and to close when the electrical current flow is halted automatically stopping the mixture flow.

3. An apparatus as described in claim 2, wherein:

said case coil spring forces the combustible coal element against the case cathode end and first tube end.

4. An apparatus as described in claim 3, wherein the coal is anthracite.

5. An apparatus as described in claim 4, wherein:

the socket is made from alloys that are electrical conductors and reaction catalysts selected from the group consisting of natural pyrite, $Fe_2O_3$, synthetic $FeS_2$, and compounds of Fe, Co, Ni, or Mo, the compounds deposited on $Al_2O_3$.

6. An apparatus as described in claim 5, wherein:

said water impervious compound is selected from the group consisting of nickel or chromium.

* * * * *